US009099808B2

(12) United States Patent
Kato et al.

(10) Patent No.: US 9,099,808 B2
(45) Date of Patent: Aug. 4, 2015

(54) SHIELDED CONNECTOR

(71) Applicant: YAZAKI CORPORATION, Minato-ku, Tokyo (JP)

(72) Inventors: Hajime Kato, Shizuoka (JP); Hiroshi Shinba, Tokyo (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/215,168

(22) Filed: Mar. 17, 2014

(65) Prior Publication Data

US 2014/0199876 A1 Jul. 17, 2014

Related U.S. Application Data

(63) Continuation of application No. PCT/JP2012/006156, filed on Sep. 26, 2012.

(30) Foreign Application Priority Data

Sep. 27, 2011 (JP) ..... 2011-210871

(51) Int. Cl.

| | |
|---|---|
| ***H01R 13/53*** | (2006.01) |
| ***H01R 13/631*** | (2006.01) |
| ***H01R 13/627*** | (2006.01) |
| ***H01R 13/453*** | (2006.01) |
| ***H01R 13/629*** | (2006.01) |
| ***H01R 13/6592*** | (2011.01) |
| *H01R 13/635* | (2006.01) |

(52) U.S. Cl.

CPC ..... *H01R 13/627* (2013.01); *H01R 13/4538* (2013.01); *H01R 13/62938* (2013.01); *H01R 13/6592* (2013.01); *H01R 13/635* (2013.01)

(58) Field of Classification Search

CPC .. H01R 13/4538; H01R 13/53; H01R 13/631; H01R 13/6485; H01R 13/527; H01R 13/4534; H01R 13/447

See application file for complete search history.

(56) References Cited

U.S. PATENT DOCUMENTS

| | | | | |
|---|---|---|---|---|
| 5,466,164 | A | 11/1995 | Miyazaki et al. | |
| 5,501,606 | A * | 3/1996 | Oda et al. | 439/140 |
| 5,558,526 | A * | 9/1996 | Nagamine | 439/140 |
| 6,129,585 | A | 10/2000 | Hashizawa et al. | |
| 6,846,191 | B2 * | 1/2005 | Hobbs et al. | 439/157 |

(Continued)

FOREIGN PATENT DOCUMENTS

| | | |
|---|---|---|
| EP | 0615312 A2 | 9/1994 |
| EP | 1923964 A2 | 5/2008 |

(Continued)

*Primary Examiner* — Gary Paumen

(74) *Attorney, Agent, or Firm* — Marvin A. Motsenbocker; Mots Law, PLLC

(57) ABSTRACT

A male connector has a moving plate which is movable between an initial position and a retreat position, and an initial position locking part which immovably locks the moving plate with respect to a male housing in the initial position. A female connector has a locking releasing part which, when a female housing is inserted into an opening of the male housing, engages with the initial position locking part to release the locking of the moving plate with respect to the male housing. The moving plate is moved from the initial position to the retreat position by insertion of the female housing inside the male housing in a state that the locking by the initial position locking part has been released by the locking releasing part.

3 Claims, 19 Drawing Sheets

(56) References Cited

U.S. PATENT DOCUMENTS

| | | | | |
|---|---|---|---|---|
| 6,896,531 | B2 * | 5/2005 | Bakker et al. | 439/140 |
| 7,134,901 | B2 * | 11/2006 | Okura | 439/372 |
| 7,267,562 | B2 * | 9/2007 | Katsuma | 439/140 |
| 7,581,969 | B2 * | 9/2009 | Matsushita | 439/140 |
| 8,038,455 | B1 * | 10/2011 | Moraes et al. | 439/140 |
| 2003/0119349 | A1 * | 6/2003 | Bakker et al. | 439/140 |
| 2004/0147163 | A1 | 7/2004 | Chou | |
| 2006/0205264 | A1 * | 9/2006 | Katsuma | 439/381 |
| 2008/0119074 | A1 | 5/2008 | Okano | |
| 2011/0281448 | A1 * | 11/2011 | Gloaguen et al. | 439/181 |

FOREIGN PATENT DOCUMENTS

| | | | |
|---|---|---|---|
| JP | H11-126657 | A | 5/1999 |
| WO | 0046881 | A1 | 8/2000 |
| WO | 2007139368 | A1 | 12/2007 |

* cited by examiner

SHIELDED CONNECTOR

CROSS REFERENCE TO RELATED APPLICATION

This is a continuation application based on PCT application No. PCT/JP2012/006156 filed on Sep. 26, 2012, which claims the benefit of priority from Japanese Patent Application No. 2011-210871 filed on Sep. 27, 2011, the entire contents of which are incorporated by reference herein.

BACKGROUND OF THE INVENTION

1. Field of the Invention

The present invention relates to a shielded connector including a male connector and a female connector.

2. Description of the Related Art

In recent years, with the widespread use of electric vehicles and the like, the connector including a male connector which houses a male terminal and a female connector which houses a female terminal has been used under high voltage conditions.

For example, as a connector for use under high voltage conditions, a shielded connector has been known which is provided with metallic shells to be electrically connected to braided wires of shielded electric wires inside a male housing of a male connector and a female housing of a female connector, respectively (for example, refer to PTL 1: Japanese Patent Application Laid-Open Publication No. H11(1999)-126657). In this shielded connector, upon fitting of the male connector and the female connector, the metallic shell of the male connector and that of the female connector fit to each other to connect their respective braided wires of the shielded electric wires to each other, thus achieving a high-frequency shield.

However, with conventional shielded connectors, in order to accommodate high-voltage electrical conduction, the sizes of the shielded electric wire and the male and female terminals (hereinafter referred to as the terminal) have been made larger, and as a result of this, the sizes of the male connector and the female connector have also been made larger. Consequently, the male housing and the female housing have been provided with a wider opening, which has created the possibility that, upon disengagement of the male connector and the female connector, a tool or the like may directly touch the terminal to cause an electrical problem. Therefore, there has been a room for improvement in the protection of the terminal against a tool or the like having a potential for contact with the terminal.

SUMMARY OF THE INVENTION

It is an object of the present invention to provide a shielded connector which is capable of ensuring protection of the terminal against a tool or the like having a potential for contact with the terminal, upon disengagement of the male connector and the female connector.

In accordance with a first aspect of the present invention, there is provided a shielded connector comprising: a first connector having a first housing in which a first terminal is housed; and a second connector having a second housing in which a second terminal is housed and being fitted to the first connector, wherein the second housing is inserted inside the first housing, and thereby the first connector and the second connector are fitted to each other to connect the first terminal and the second terminal, the first connector has: a moving plate which is housed inside the first housing, and is movable between an initial position on the near side of the first terminal and a retreat position on the back side thereof in an insertion direction of the second housing; and an initial position locking part for immovably locking the moving plate with respect to the first housing in the initial position by locking a locking piece provided to the moving plate with respect to the initial position locking part, the second connector has: a locking releasing part which, when the second housing is inserted into an opening of the first housing, is abutted against the locking piece to elastically deform the locking piece so as to release the locking of the moving plate with respect to the initial position locking part, and a plate pulling-back piece which, when the locking piece is elastically deformed, is abutted against a pulling-back locking piece provided in a location opposed to the locking piece, and the moving plate moves from the initial position to the retreat position by the insertion of the second housing inside the first housing in a state that the locking releasing part has released the locking of the moving plate by the initial position locking part to elastically deform the locking piece, and the moving plate moves from the retreat position to the initial position when the plate pulling-back piece is abutted against the pulling-back locking piece by the disengagement of the second housing from the first housing.

In accordance with the first aspect of the present invention, the first connector has the initial position locking part which immovably locks the moving plate with respect to the first housing in the initial position. Thereby, the moving plate can block the opening of the first housing upon disengagement of the first connector and the second connector. Therefore, a tool or the like or a finger of the operator can be prevented from touching the first terminal, and protection of the first terminal against a tool or the like having a potential for contact with the first terminal can be ensured. In addition, even if the operator has pressed the moving plate to the retreat position side, since the moving plate is locked to the initial position locking part, protection of the first terminal against a tool or the like having a potential for contact with the first terminal can be reliably ensured.

Furthermore, in a state that the locking releasing part has released the locking of the moving plate by the initial position locking part, by the insertion of the second housing inside the first housing, the moving plate moves from the initial position to the retreat position. Thereby, since by simply inserting the second housing into the opening of the first housing, the moving plate moves to the retreat position, there is no need to daringly remove the moving plate from the first housing, and whereby the first connector and the second connector can be easily fitted to each other.

In accordance with a second aspect of the present invention, the initial position locking part includes a locking wall which is housed inside the first housing and extends along the insertion direction, and the tip of the locking wall faces the opening of the first housing, the moving plate has an elastic deformation part which has, at the tip of the elastic deformation part exposed to the opening of the first housing, the locking piece which is locked to the tip of the locking wall in the initial position, and the locking releasing part has a lock releasing piece which is abutted against the locking piece when the second housing is inserted into the opening of the first housing, and elastically deforms the elastic deformation part such that the locking of the locking piece with respect to the locking wall is released.

In accordance with the second aspect of the present invention, the lock releasing piece is abutted against the locking piece when the second housing is inserted into the opening of the first housing, and elastically deforms the elastic deformation part such that the locking of the locking piece with respect to the locking wall is released. Thereby, with a simple construction, protection of the first terminal against a tool or the like having a potential for contact with the first terminal can be reliably ensured. In addition, by simply inserting the second housing into the opening of the first housing, the locking of the locking piece with respect to the locking wall is released, and whereby the first connector and the second connector can be still more easily fitted to each other.

In accordance with a third aspect of the present invention, the second connector has the plate pulling-back piece which, in cooperation with the lock releasing piece, sandwiches the elastic deformation part that has been elastically deformed by abutting against the lock releasing piece, and the moving plate returns, upon disengagement of the first connector and the second connector from each other, from the retreat position to the initial position along with the movement of the lock releasing piece and the plate pulling-back piece which sandwich the elastic deformation part therebetween to the opening side of the first housing; and becomes immovable with respect to the first housing in the initial position when the lock releasing piece is disengaged from the tip of the elastic deformation part and the locking piece is locked to the locking wall.

In accordance with the third aspect of the present invention, the moving plate returns from the retreat position to the initial position upon disengagement of the first connector and the second connector, and in the initial position, becomes immovable with respect to the first housing. Thereby, along with disengagement of the second connector from the first connector, the moving plate can block the opening of the first housing. Therefore, even if the first connector and the second connector are disengaged from each other, protection of the first terminal against a tool or the like having a potential for contact with the first terminal can be more reliably ensured.

In accordance with a fourth aspect of the present embodiment, the first connector includes a lever which fits and disengages the first connector and the second connector by rotation; one member of the lever and the moving plate has a pin, while the other member of the lever and the moving plate has a guide hole into which the pin is inserted; and in the movement of the pin with respect to the guide hole along with the rotation of the lever, a movement component of the second connector with respect to the first connector in a fitting/disengagement direction moves the moving plate between the initial position and the retreat position.

In accordance with the fourth aspect of the present invention, the movement component of the second connector with respect to the first connector in the fitting/disengagement direction moves the moving plate between the initial position and the retreat position. Thereby, along with the rotation of the lever, the moving plate can be moved between the initial position and the retreat position. Therefore, with protection of the first terminal against a tool or the like having a potential for contact with the first terminal being ensured, fitting/disengagement of the male connector and the female connector to/from each other can be easily performed.

In accordance with features of the present invention, a shielded connector can be provided which, upon disengagement of the male connector and the female connector from each other, can ensure protection of the terminal against a tool or the like having a potential for contact with the terminal.

DESCRIPTION OF THE EMBODIMENTS

Next, embodiments of a shielded connector in accordance with the present invention will be described below with reference to the drawings. Specifically, a first embodiment, a second embodiment, and other embodiments will be described.

Note that, in the following reference to the drawings, the same or similar components are provided with the same or similar numerals. However, the drawings are schematic, and the ratio of a particular size to another, or the like, differs from the real one.

Therefore, any specific size, or the like, should be judged in consideration of the following descriptions. In addition, between any two drawings, there may be a mutual difference in relationship or ratio of a particular size to another.

First Embodiment

(1) Construction of Shielded Connector 1

Figure 1A:
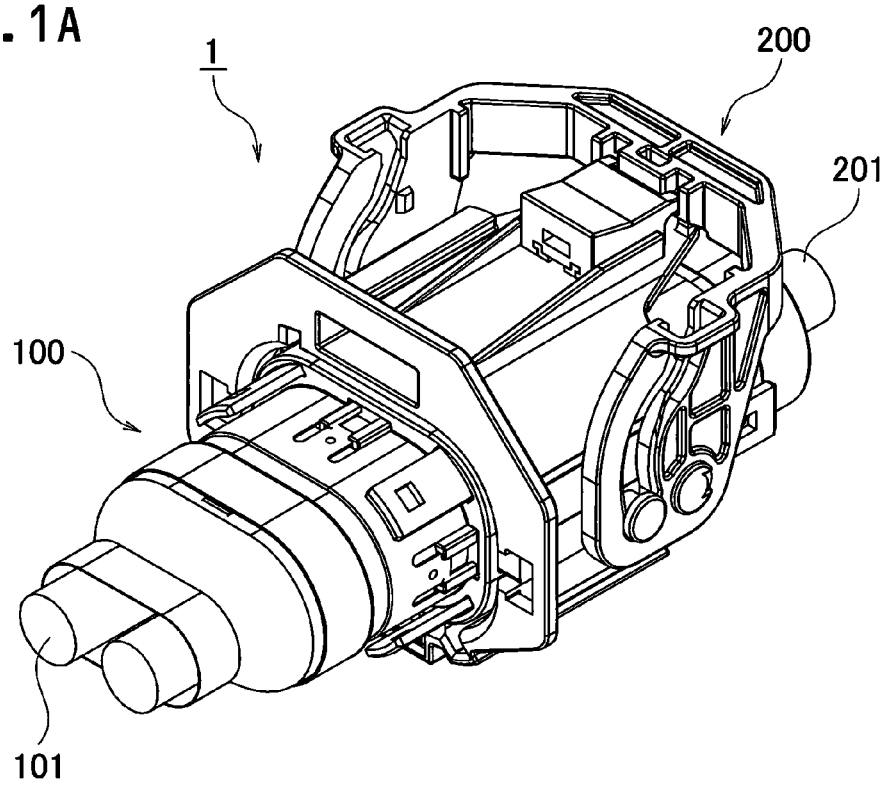
FIG. 1A is a perspective view of a shielded connector 1 according to a first embodiment of the present invention, when viewed from a male connector 100 side.
Figure 1B:
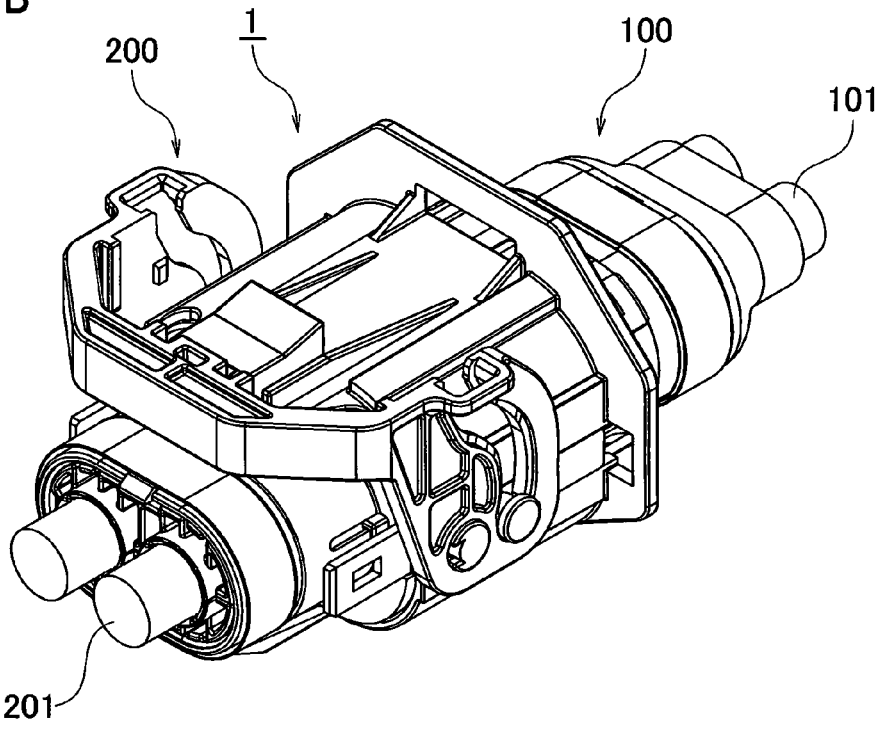
FIG. 1B is a perspective view of the shielded connector 1 according to the first embodiment of the present invention, when viewed from a female connector 200 side.
Figure 2A:
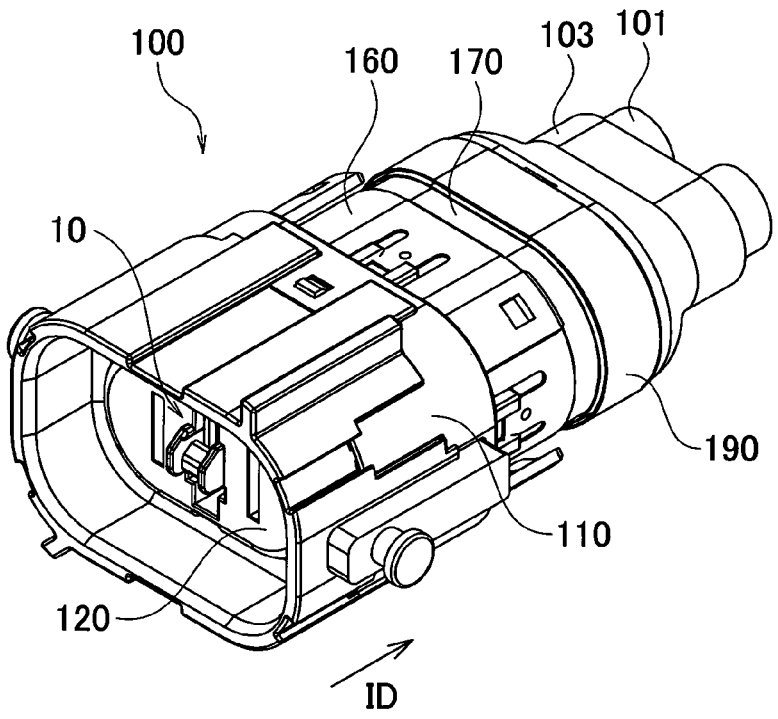
FIG. 2A is a perspective view of the male connector 100 according to the first embodiment of the present invention, when viewed from the fitting side of the male connector 100.
Figure 2B:
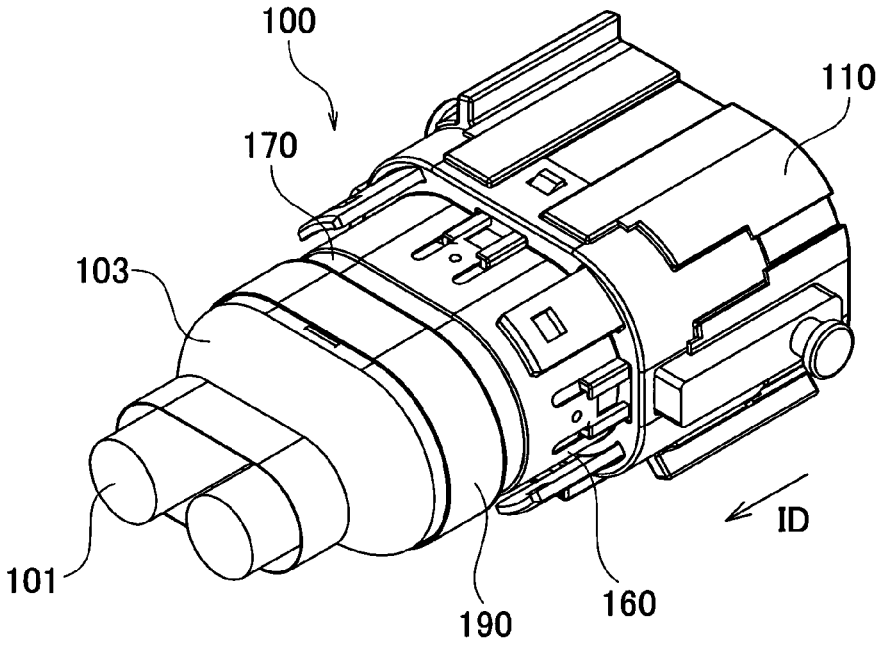
FIG. 2B is a perspective view of the male connector 100 according to the first embodiment of the present invention, when viewed from the disengagement side of the male connector 100.
Figure 3:
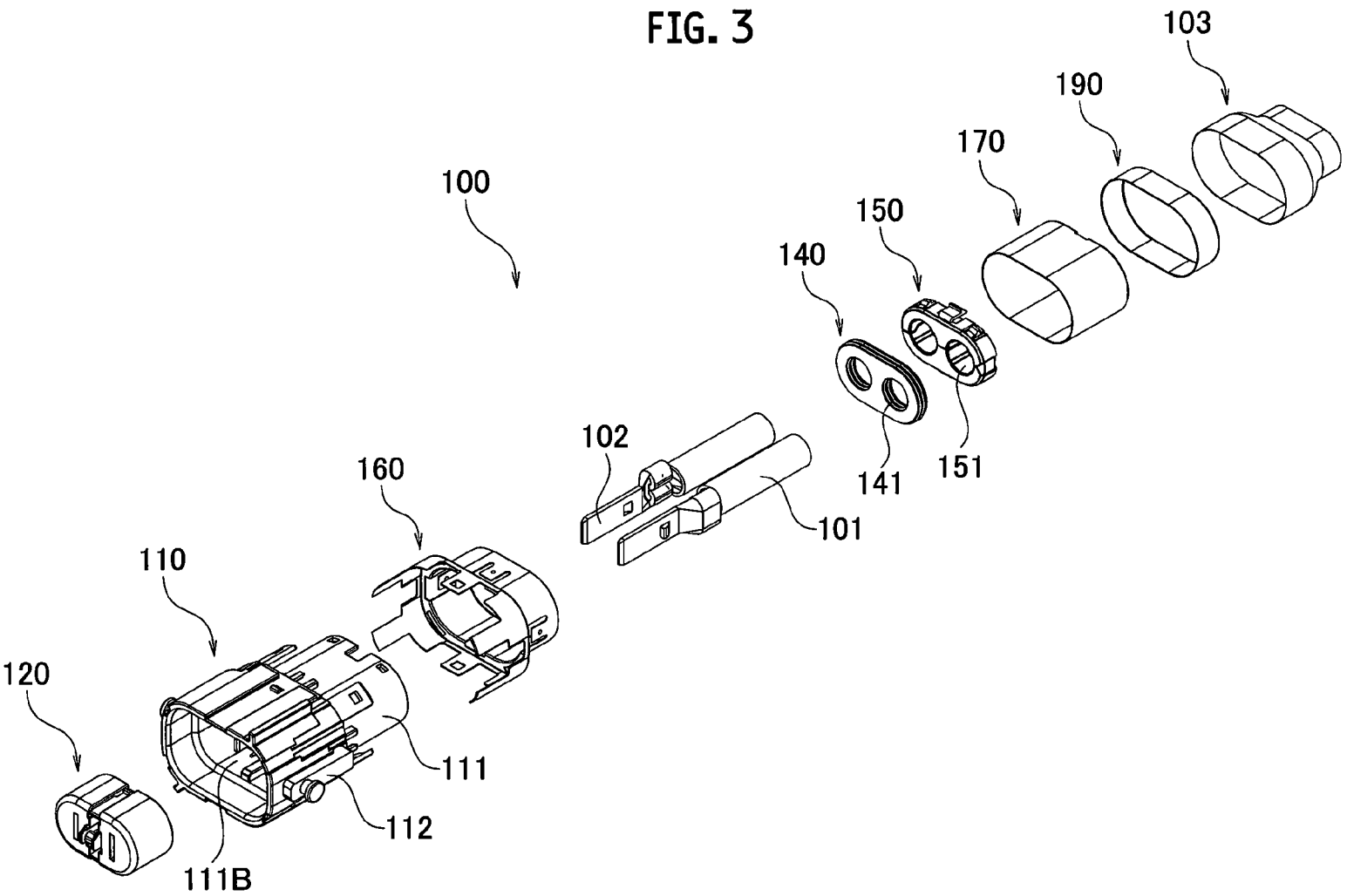
FIG. 3 is an exploded perspective view of the male connector 100 according to the first embodiment of the present invention.
Figure 4A:
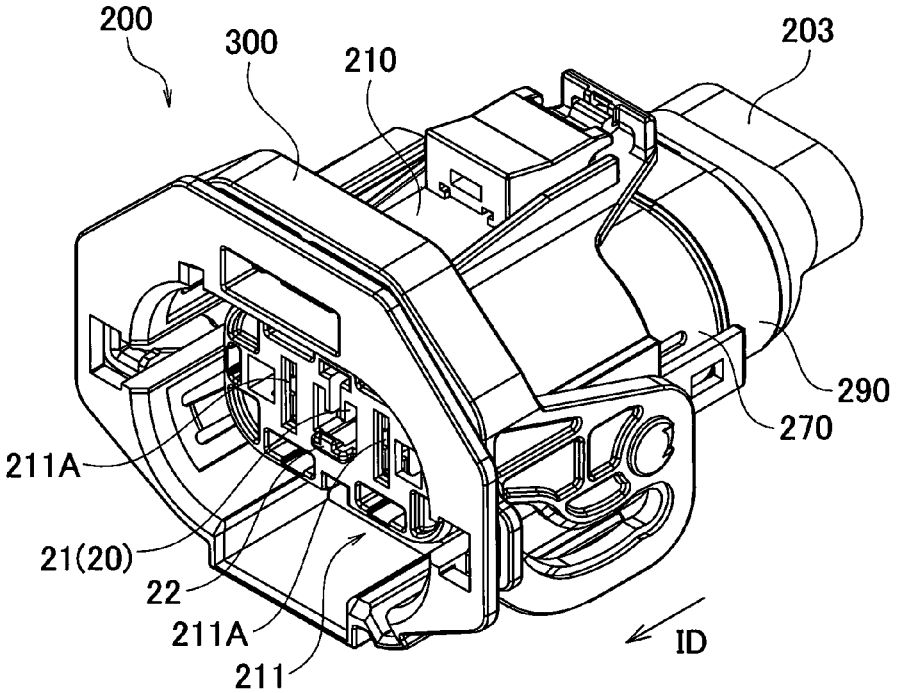
FIG. 4A is a perspective view of the female connector 200 according to the first embodiment of the present invention, when viewed from the fitting side of the female connector 200.
Figure 4B:
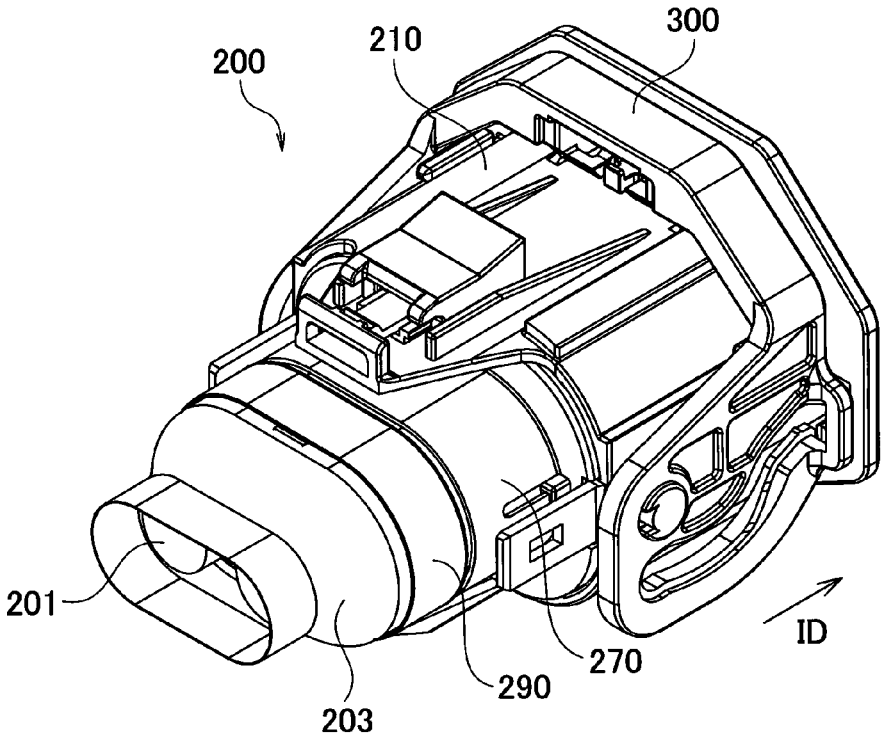
FIG. 4B is a perspective view of the female connector 200 according to the first embodiment of the present invention, when viewed from the disengagement side of the female connector 200.
Figure 5:
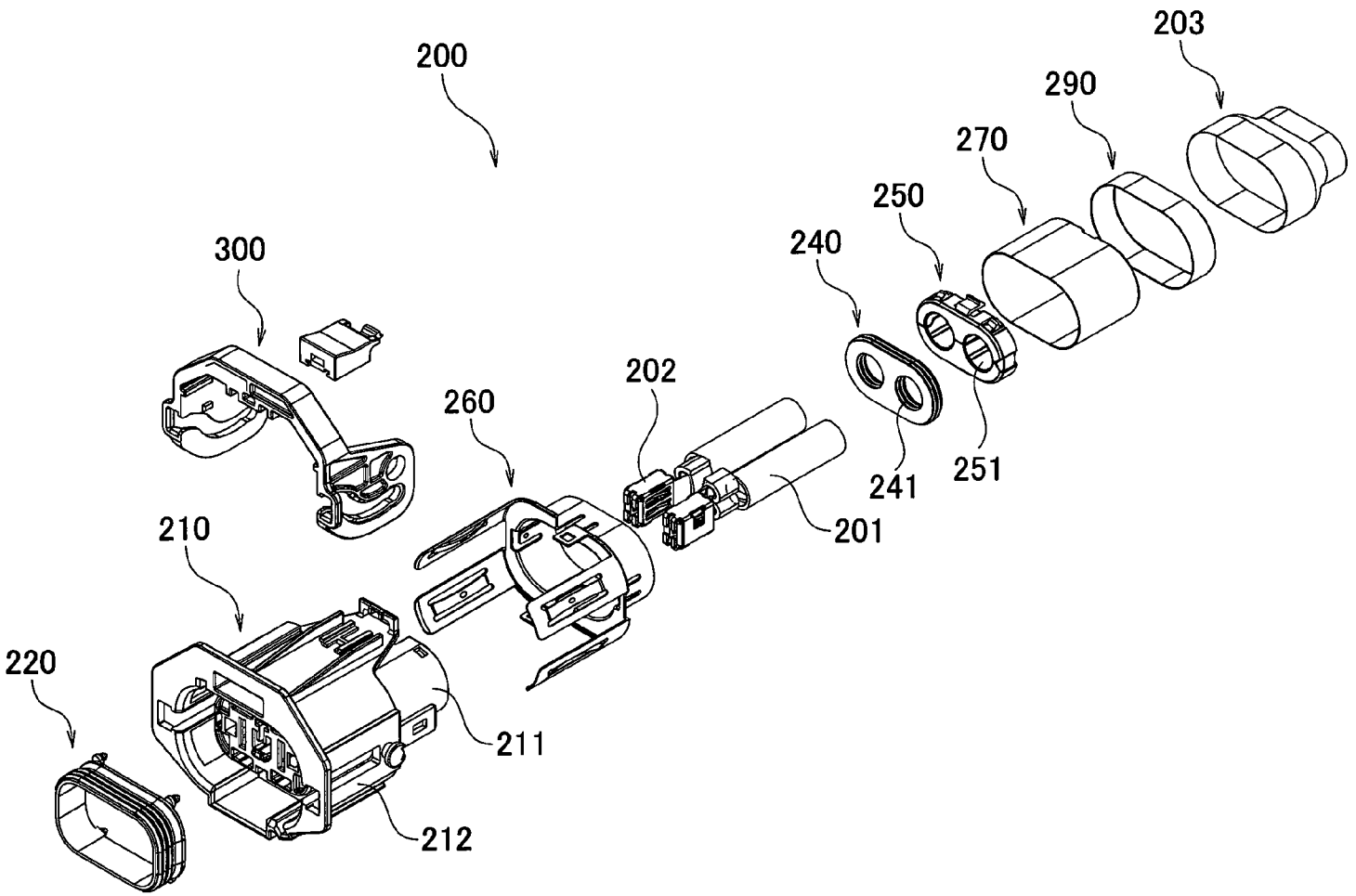
FIG. 5 is an exploded perspective view of the female connector 200 according to the first embodiment of the present invention.
Figure 6A:
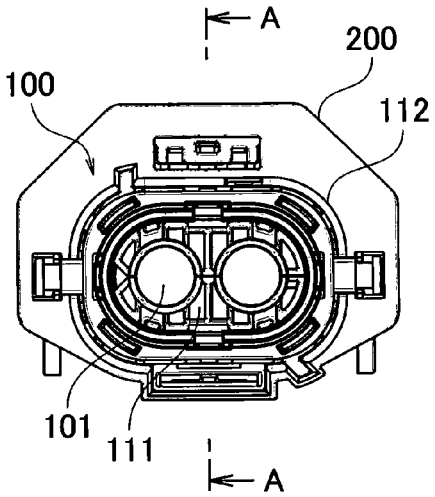
FIG. 6A is a front view of the shielded connector 1 according to the first embodiment of the present invention.
Figure 6B:
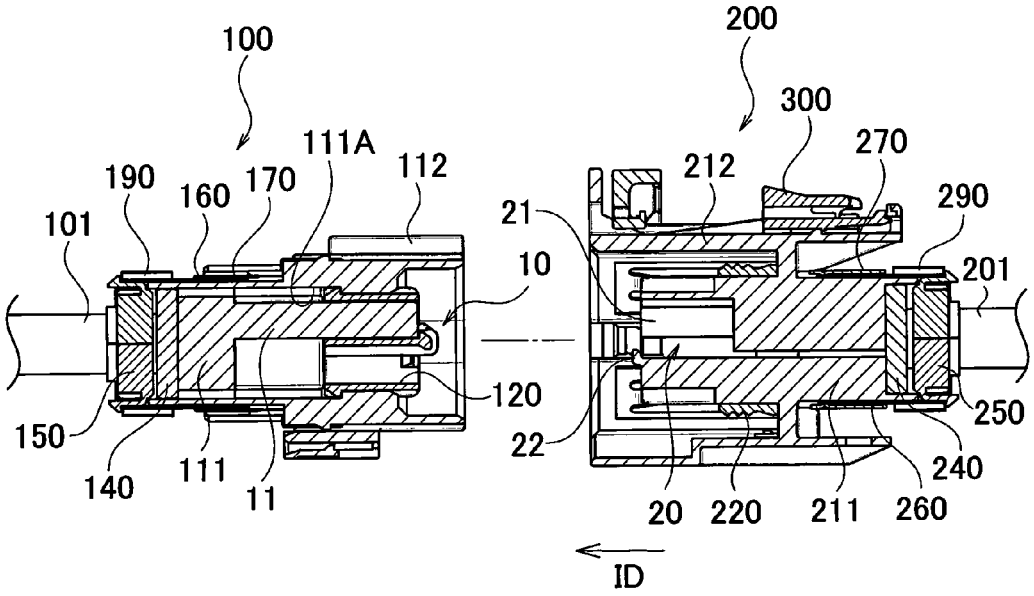
FIG. 6B is a longitudinal sectional view of the shielded connector 1 according to the first embodiment of the present invention.

First, the construction of a shielded connector 1 according to a first embodiment will be described with reference to the drawings. FIGS. 1A and 1B are perspective views of the shielded connector 1 according to the first embodiment. FIGS. 2A and 2B are perspective views of a male connector 100 according to the first embodiment. FIG. 3 is an exploded perspective view of the male connector 100 according to the first embodiment. FIGS. 4A and 4B are perspective views of a female connector 200 according to the first embodiment. FIG. 5 is an exploded perspective view of the female connector 200 according to the first embodiment. FIGS. 6A and 6B are a front view and a longitudinal sectional view of the shielded connector 1 according to the first embodiment, respectively.

In the following descriptions, the longitudinal direction of the terminal (the electric wire) is referred to as the "longitudinal direction" of the shielded connector 1 (or of any other member). Especially, in the male connector 100, the fitting side of the male connector 100 and the female connector 200 (near side in FIG. 2A) is referred to as the "front side", while the disengagement side (back side where electric wires are extended in FIG. 2A), which is opposite to the front side, is referred to as the "rear side". Likewise, in the female connector 200, the fitting side of the male connector 100 and the female connector 200 (near side in FIG. 4A) is referred to as the "front side", while the disengagement side (back side where electric wires are extended in FIG. 4A), which is opposite to the front side, is referred to as the "rear side". In addition, the direction in which a plurality of terminals is arranged is referred to as the "crosswise direction", and a direction which is orthogonal to the longitudinal direction and the crosswise direction is referred to as the "vertical direction".

The shielded connector 1 as shown in FIGS. 1A to 3 is attached to the ends of two multi-core shielded cables in which electric wires 101 and 201 are covered with braided wires 103 and 203, and are used for connecting the multi-core shielded cables to each other.

The shielded connector 1 is comprised of a male connector 100 (a first connector) which has a male housing 110 (a first housing), and a female connector 200 (a second connector) which has a female housing 210 (a second housing) and fits with the male connector 100.

With the female housing 210 being inserted inside the male housing 110, the male connector 100 and the female connector 200 fit each other to connect a male terminal 102 and a female terminal 202.

(2) Male Connector 100

As shown in FIGS. 2A and 2B, FIG. 3, and FIGS. 6A and 6B, the male housing 110 is formed of an insulating resin, and houses the male terminals 102 (the first terminals) which are crimped to the ends of the electric wires 101. The male housing 110 has an inner housing 111 and an outer housing 112 which covers the inner housing 111. The inner housing 111 and the outer housing 112 are formed integrally through a connecting portion (not shown).

On the front side inside the inner housing 111, there is provided a moving plate 120 for preventing a tool or the like or a finger of the operator from directly touching the male terminal 102. The details of the moving plate 120 will be described later.

On the rear side inside the inner housing 111 (on the outer periphery of the electric wire 101), there is provided a rubber plug 140 which is formed of an insulating rubber material. The rubber plug 140 has electric wire insertion holes 141 into which the electric wires 101 are inserted, and tightly contacts with the inner periphery of the inner housing 111 and the outer periphery of the electric wire 101. On the rear side of the rubber plug 140, there is provided a rear holder 150 for regulating the movement of the electric wire 101. The rear holder 150 has electric wire insertion holes 151 into which the electric wires 101 are inserted, supporting the electric wires 101 while preventing the rubber plug 140 from getting out of the inner housing 111.

Moreover, on the outer periphery of the inner housing 111, there are provided a cylindrical metallic shell main body 160 and a braided wire fixing member 170 which is fitted to the metallic shell main body 160. To the braided wire fixing member 170, the braided wire 103 is crimped by a braided wire crimping member 190, and thereby the braided wire 103 and the metallic shell main body 160 are conduction-connected to each other.

On the inner face of such inner housing 111, there is formed a protrusion guide groove 111A as shown in FIGS. 6A and 6B. In addition, inside the inner housing 111, there is formed a terminal housing chamber 111B (see FIG. 3) in which two male terminals 102 are to be housed.

Furthermore, inside the inner housing 111 (inside the terminal housing chamber 111B), there is provided an initial position locking part 10 (see FIGS. 6A and 6B) for immovably locking the moving plate 120 with respect to the inner housing 111 in the initial position on the near side of the male terminal 102 in an insertion direction ID of the female housing 210.

The initial position locking part 10 is configured to include a locking wall 11 which is housed inside the inner housing 111, being extended along the insertion direction ID of the female housing 210, and the tip of the locking wall 11 faces an opening of the inner housing 111, and a part of the moving plate 120 (a locking piece 131 to be described later).

(3) Female Connector 200

As shown in FIGS. 1A, 1B, and 4A to 6B, the female housing 210 is formed of an insulating resin as with the male housing 110, and houses female terminals 202 (second terminals) which are crimped to the ends of the electric wires 201. The female housing 210 has an inner housing 211 and an outer housing 212 which covers this inner housing 211, and the inner housing 211 and the outer housing 212 are integrally formed through a connecting portion (not shown).

On the front side inside the inner housing 211, there is provided a packing 220 which is formed of an insulating rubber material. When the male connector 100 and the female connector 200 are fitted to each other, the packing 220 is tightly contacted with the inner periphery of the outer housing 112 of the male housing 110 and the inner periphery of the outer housing 212 of the female housing 210.

On the rear side in the inside of the inner housing 211 (on the outer periphery of the electric wire 201), there is provided a rubber plug 240 which is formed of an insulating rubber material. The rubber plug 240 has electric wire insertion holes 241 into which the electric wires 201 are inserted, and tightly contacts the inner periphery of the inner housing 211 and the outer periphery of the electric wire 201. On the rear side of the rubber plug 240, there is provided a rear holder 250 for regulating the movement of the electric wire 201. The rear holder 250 has electric wire insertion holes 251 into which the electric wires 201 are inserted, supporting the electric wires 201 while preventing the rubber plug 240 from getting out of the inner housing 211.

In addition, on the outer periphery of the inner housing 211, there are provided a cylindrical metallic shell main body 260 and a braided wire fixing member 270 which is fitted to the metallic shell main body 260. To the braided wire fixing member 270, the braided wire 203 is crimped by a braided wire crimping member 290, and thereby the braided wire 203 and the metallic shell main body 260 are conduction-connected to each other. Thereby, when the male connector 100 and the female connector 200 are fitted to each other, the metallic shell main body 260 is fitted to the metallic shell main body 160, which is provided in the male connector 100, and thereby the braided wire 103 and the braided wire 203 are conduction-connected to each other.

Moreover, on the outer periphery of the inner housing 211, there is provided a lever 300 which can rotate with respect to the inner housing 211. By rotation of the lever 300, the male connector 100 and the female connector 200 can be fitted to and disengaged from each other.

Inside such inner housing 211, there are formed terminal insertion holes 211A into which the male terminals 102 are insertable. In addition, inside the inner housing 211, there is formed a terminal housing chamber (not shown) in which the two female terminals 202 are housed.

Furthermore, inside the inner housing 211, as shown in FIGS. 4A and 4B and FIGS. 6A and 6B, there is provided a locking releasing part 20 which, when the inner housing 211 is inserted into the opening (the terminal housing chamber 111B) of the inner housing 111, engages with the initial position locking part 10 to release the locking of the moving plate 120 on the inner housing 111.

Upon the male connector 100 being fitted to the female connector 200, the locking releasing part 20 is provided in a location displaced in a crosswise direction in the initial position locking part 10. The locking releasing part 20 has a lock releasing piece 21 which, with the inner housing 211 being inserted into an opening of the inner housing 111, is abutted against the moving plate 120 (the locking piece 131) to release the locking of the moving plate 120 with respect to the initial position locking part 10.

In addition, inside the inner housing 211, there is provided a plate pulling-back piece 22 for moving the moving plate 120 from the retreat position to the initial position.

(4) Construction of Moving Plate 120

Figure 7A:
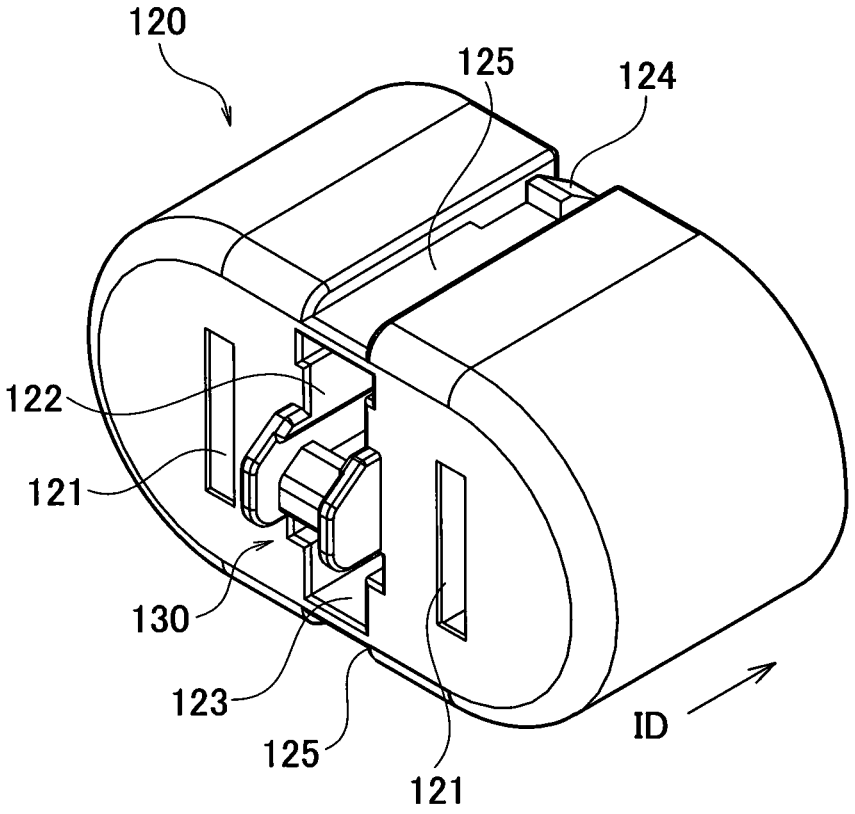
FIG. 7A is a perspective view of a moving plate 120 according to the first embodiment of the present invention.
Figure 7B:
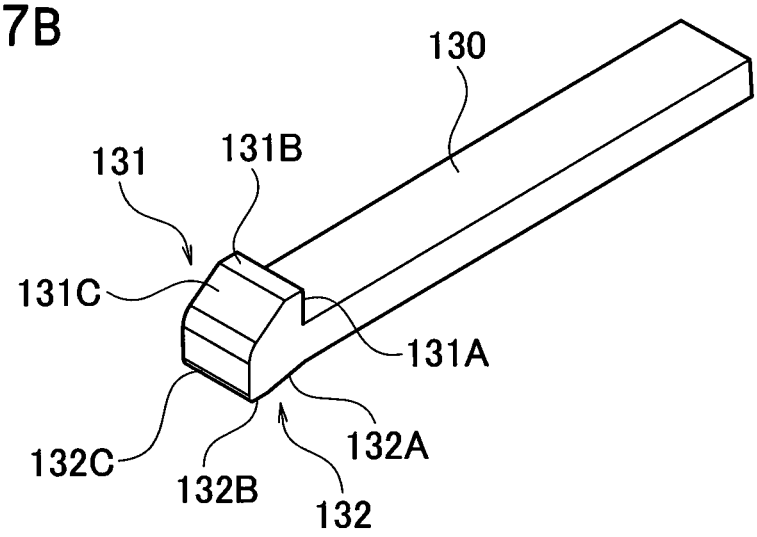
FIG. 7B is a perspective view of an elastic deformation part 130 according to the first embodiment of the present invention.
Figure 7C:
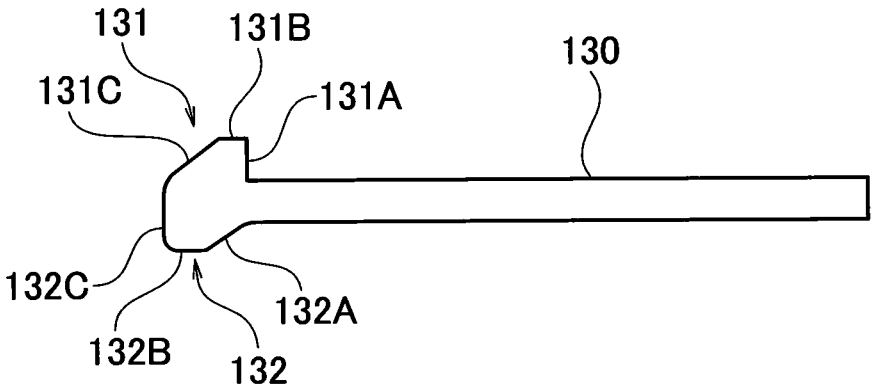
FIG. 7C is a longitudinal sectional view of the elastic deformation part 130 according to the first embodiment of the present invention.
Figure 8A:
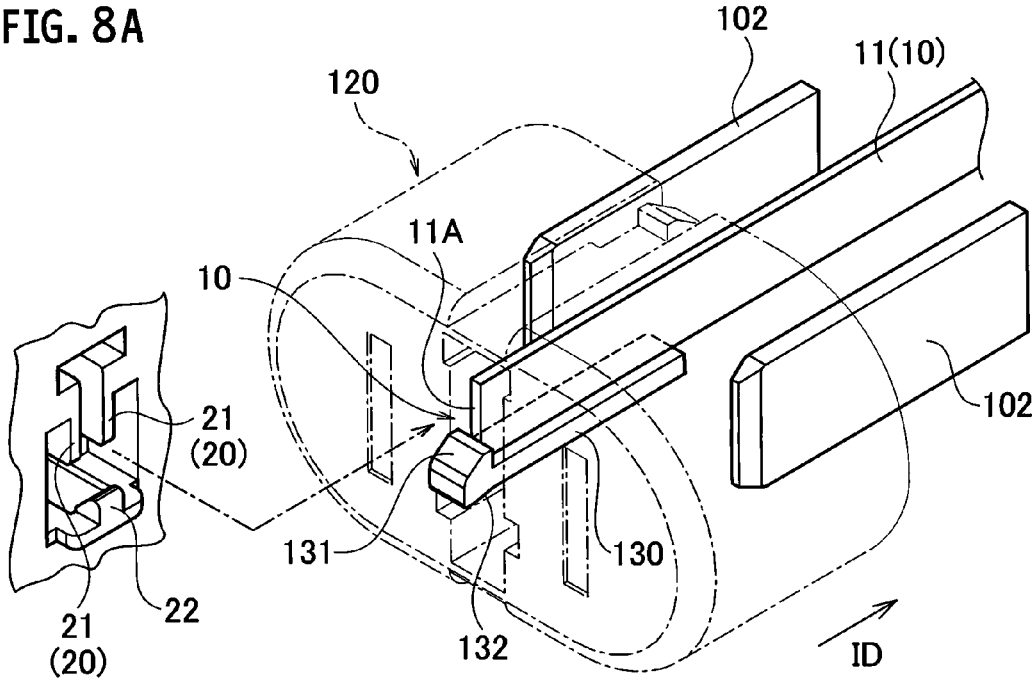
FIG. 8A is a perspective view of the moving plate 120 and a part of inner housings 111 and 211 according to the first embodiment of the present invention, when the moving plate 120 is in the initial position.
Figure 8B:
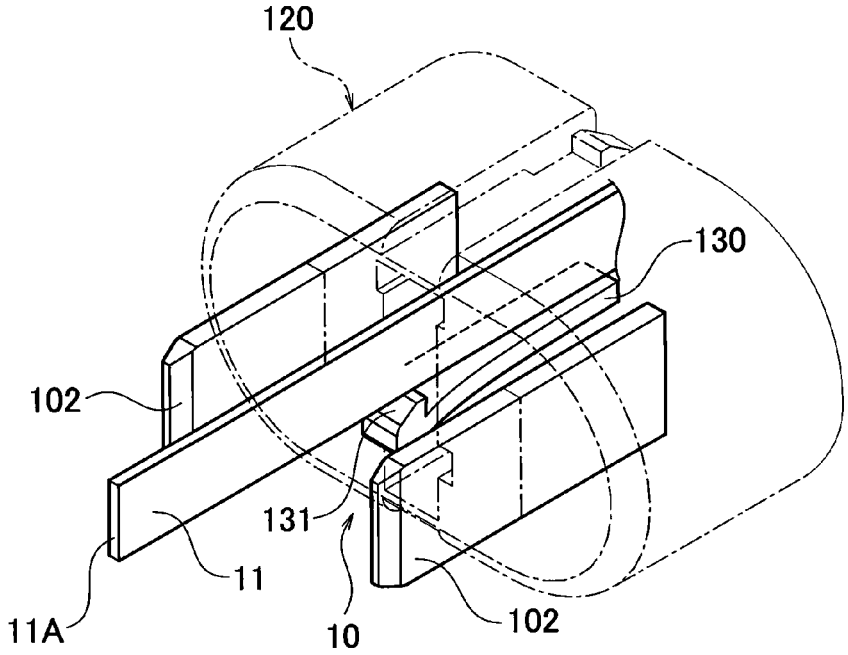
FIG. 8B is a perspective view of the moving plate 120 and a part of the inner housings 111 and 211 according to the first embodiment of the present invention, when the moving plate 120 is in the retreat position.

Next, the construction of the moving plate 120 will be described with reference to the drawings. FIGS. 7A and 7B are views of the moving plate 120 according to the first embodiment. FIGS. 8A and 8B are perspective views of the moving plate 120 and a part of the inner housings 111 and 211 according to the first embodiment.

As shown in FIGS. 7A and 7B and FIGS. 8A and 8B, the moving plate 120 is housed inside the inner housing 111. The moving plate 120 is movable between the initial position on the near side of the male terminal 102 and the retreat position on the back side thereof in the insertion direction ID of the female housing 210.

The moving plate 120 is formed in a state that two terminal insertion holes 121 are juxtaposed in a crosswise direction into which two male terminals 102 are inserted, and which can expose the male terminals 102 to the opening of the male housing 110. In addition, in the moving plate 120, there are formed an insertion space 122 into which the initial position locking part 10 of the inner housing 111 and the lock releasing piece 21 of the inner housing 211 are insertable, and an insertion space 123 into which the plate pulling-back piece 22 is insertable.

The moving plate 120 has an elastically deformable elastic deformation part 130 whose the tip is exposed to the opening of the inner housing 111. The elastic deformation part 130 is cantilever-supported by the moving plate 120 on the back side.

The elastic deformation part 130 has, at the tip thereof exposed to the opening of the inner housing 111, a locking piece 131 which is locked to the tip face 11A of the locking wall 11 in the initial position (see FIGS. 8A and 8B). The locking piece 131 has a locking wall face 131A which is locked to the tip face 11A, a top wall face 131B which communicates with the locking wall face 131A, and an inclined wall face 131C which communicates with the top wall face 131B. The locking wall face 131A is provided such that it is orthogonal to the top face of the elastic deformation part 130. The top wall face 131B is provided along the top face of the elastic deformation part 130. The inclined wall face 131C is provided such that it is inclined with respect to the top wall face 131B.

With the inner housing 211 being inserted into the opening of the inner housing 111, the lock releasing piece 21 is abutted against the locking piece 131, and thereby the elastic deformation part 130 is elastically deformed.

The elastic deformation part 130 has a pulling-back locking piece 132 provided in a location opposed to the locking piece 131, i.e., on the bottom face of the tip (on the front side) of the elastic deformation part 130. The pulling-back locking piece 132 has a locking wall face 132A which is locked to the plate pulling-back piece 22, a lower wall face 132B which communicates with the locking wall face 132A, and a front wall face 132C which communicates with the lower wall face 132B. The locking wall face 132A is provided such that it is inclined with respect to the bottom face of the elastic deformation part 130. The lower wall face 132B is provided along the bottom face of the elastic deformation part 130.

Upon disengagement of the male connector 100 and the female connector 200, the pulling-back locking piece 132 is locked to the plate pulling-back piece 22, and is sandwiched by the lock releasing piece 21 and the plate pulling-back piece 22 in cooperation. Thereby, when the lock releasing piece 21 and the plate pulling-back piece which sandwich the elastic deformation part 130 therebetween are moved to the opening side of the inner housing 111, the moving plate 120 returns from the retreat position to the initial position.

The moving plate 120 has a locking protrusion 124 which prevents the moving plate 120 from getting out of the inner housing 111.

The locking protrusion 124 is provided on the rear side of a slide groove part 125 which is formed on the top and bottom faces of the moving plate 120, being protruded outward from the bottom face of the slide groove part 125. The locking protrusion 124 is movable in a longitudinal direction inside the protrusion guide groove 111A which is formed in the inner housing 111, being locked to the front side wall face of the protrusion guide groove 111A (see FIG. 6B).

(5) Movement of Moving Plate 120

Next, the movement of the aforementioned moving plate 120 will be described with reference to the drawings. FIGS. 9 to 15 are operational views of the fitting state of the male connector 100 and the female connector 200 according to the first embodiment.

(5.1) Fitting of Male Connector 100 and Female Connector 200

Figure 9:
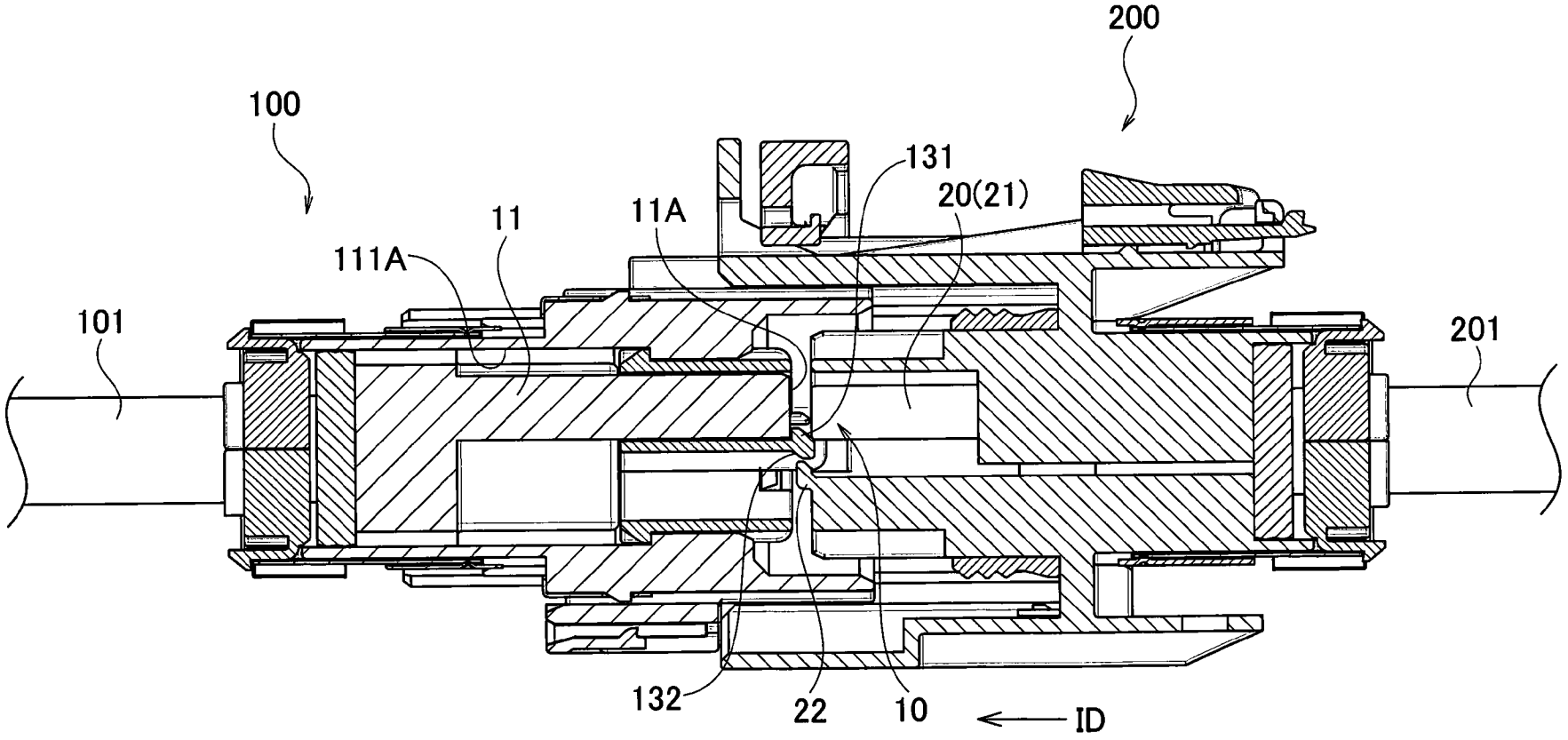
FIG. 9 is a first operational view of the fitting state of the male connector 100 and the female connector 200 according to the first embodiment of the present invention.

As shown in FIG. 9, in the state before the male connector 100 and the female connector 200 are fitted to each other, the locking piece 131 is locked to the initial position locking part 10 (the tip face 11A of the locking wall 11) inside the inner housing 111. At this time, since the moving plate 120 is positioned on the tip side of the male terminal 102, the male terminal 102 is not exposed to the opening of the male housing 110.

Figure 10:
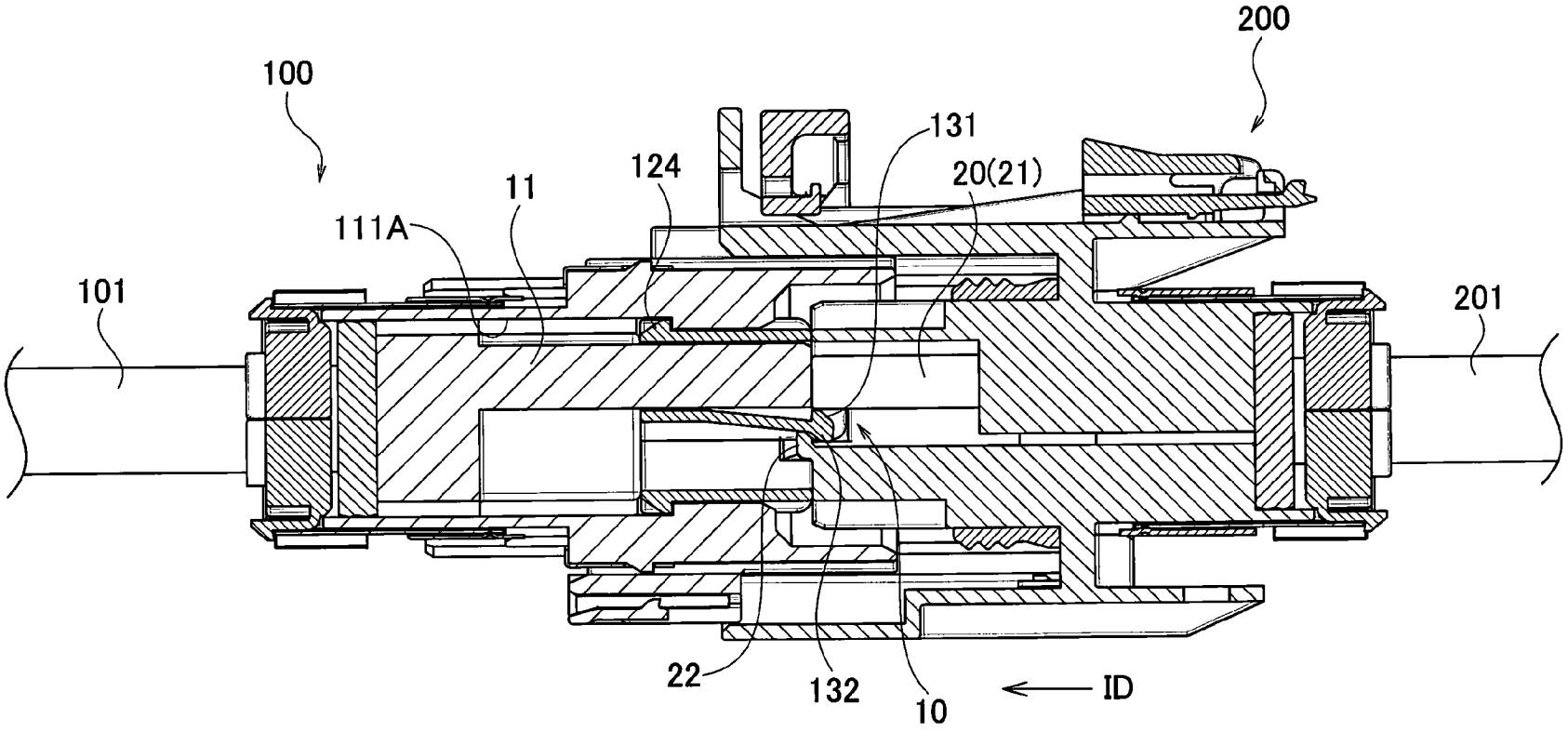
FIG. 10 is a second operational view of the fitting state of the male connector 100 and the female connector 200 according to the first embodiment of the present invention.

Next, as shown in FIG. 10, as the insertion of the female housing 210 into the male housing 110 is gradually progressed, the tip of the locking releasing part 20 (the lock releasing piece 21) inside the inner housing 211 is abutted against the locking piece 131 (the inclined wall face 131C). Then, the elastic deformation part 130 is elastically deformed, and thereby the locking of the locking piece 131 with respect to the tip face 11A is released. Furthermore, in a state that the locking releasing part 20 has released the locking of the moving plate 120 by the initial position locking part 10, the insertion of the female housing 210 inside the male housing 110 (by pressing the female housing 210) moves the moving plate 120 from the initial position to the retreat position.

Figure 11:
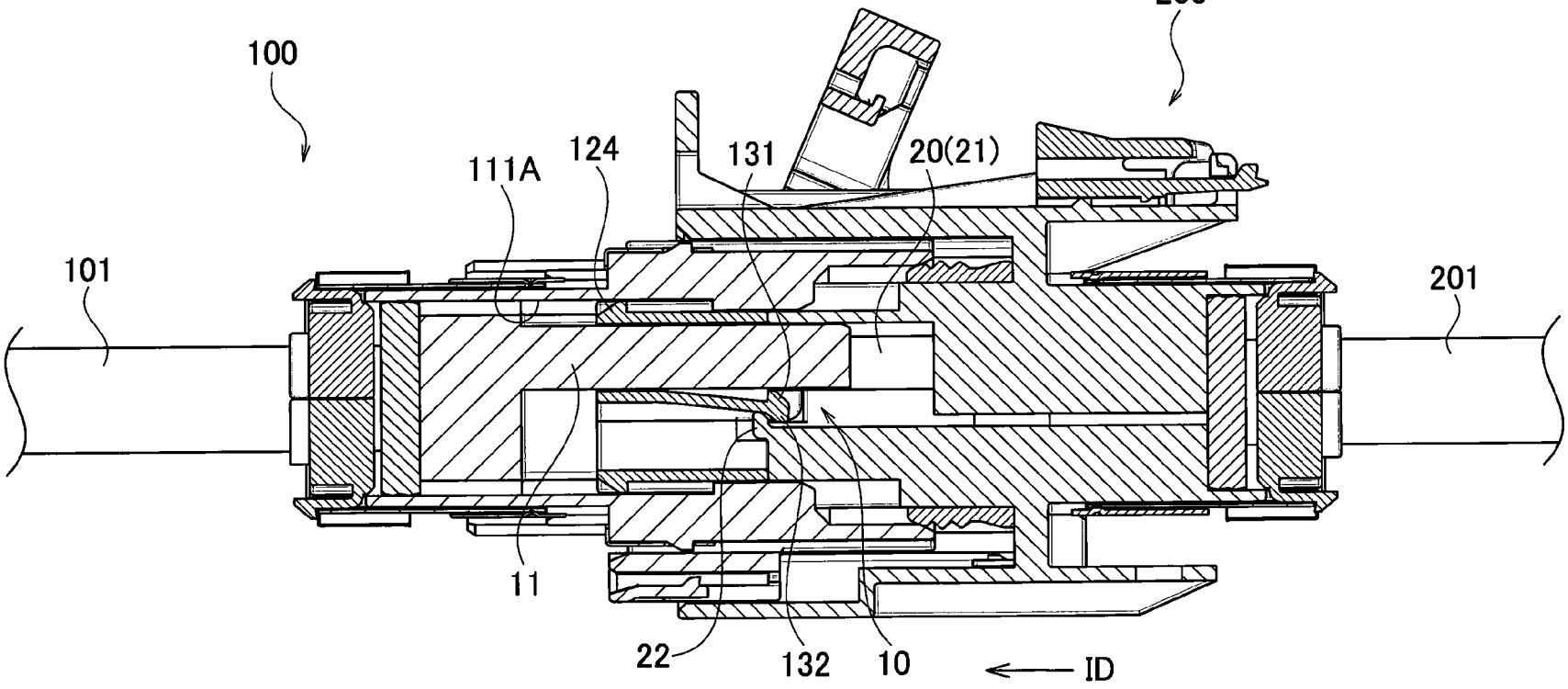
FIG. 11 is a third operational view of the fitting state of the male connector 100 and the female connector 200 according to the first embodiment of the present invention.

Then, as shown in FIG. 11, with the elastic deformation part 130 having been elastically deformed, the locking piece 131 is sandwiched between the bottom face of the lock releasing piece 21 and the plate pulling-back piece 22, and the moving plate 120 moves toward the retreat position. At this time, the male terminal 102 is inserted into the terminal insertion hole 121 to be gradually exposed to the opening of the male housing 110, while the locking protrusion 124 being slided inside the protrusion guide groove 111A.

Figure 12:
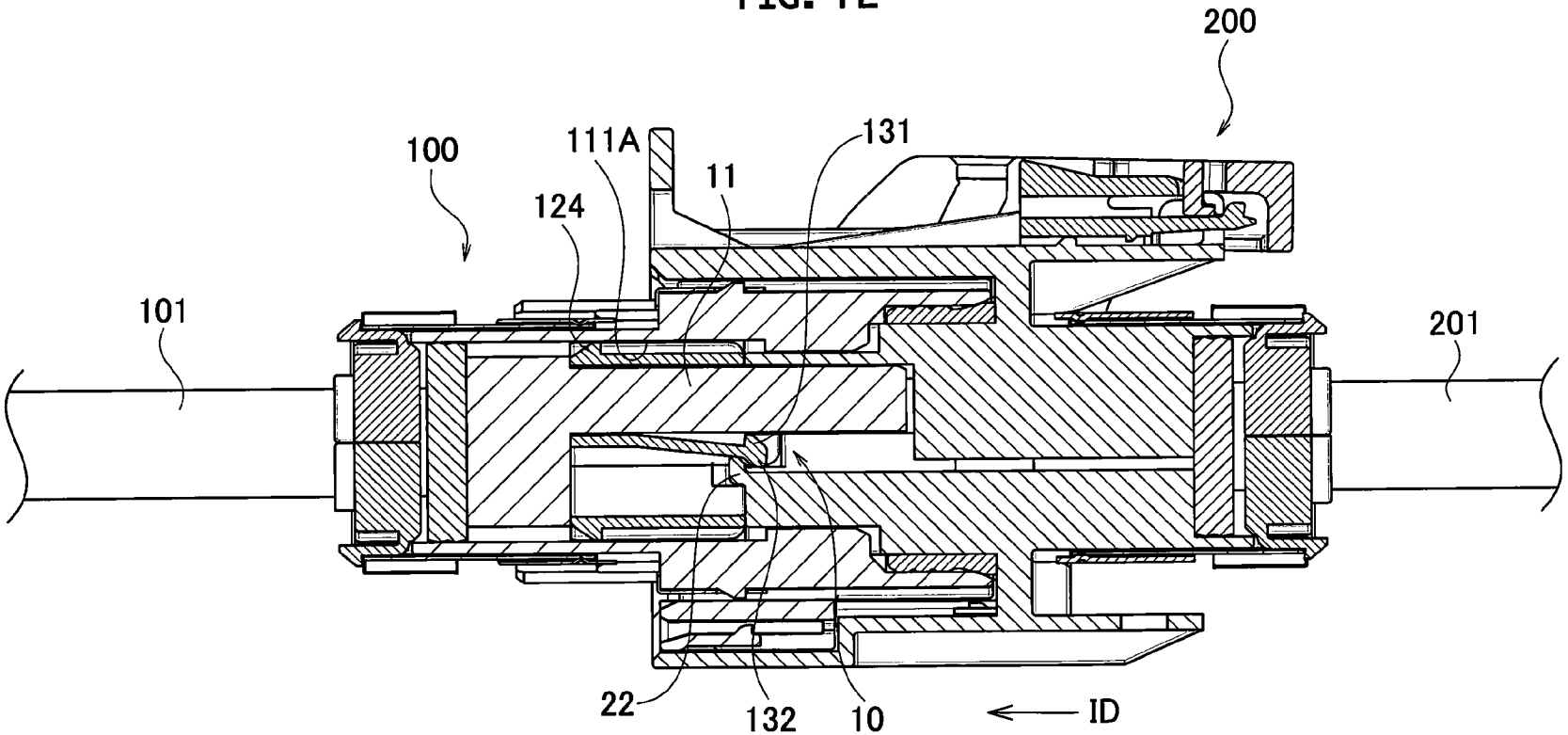
FIG. 12 is a fourth operational view of the fitting state of the male connector 100 and the female connector 200 according to the first embodiment of the present invention.

Next, as shown in FIG. 12, when the male connector 100 and the female connector 200 are fitted to each other, the male terminal 102 is thoroughly exposed to the opening of the male housing 110, being inserted into the terminal insertion hole 121, and thereby the male terminal 102 and the female connector 200 are conduction-connected to each other.

(5.2) Disengagement of Male Connector 100 and Female Connector 200

Figure 13:
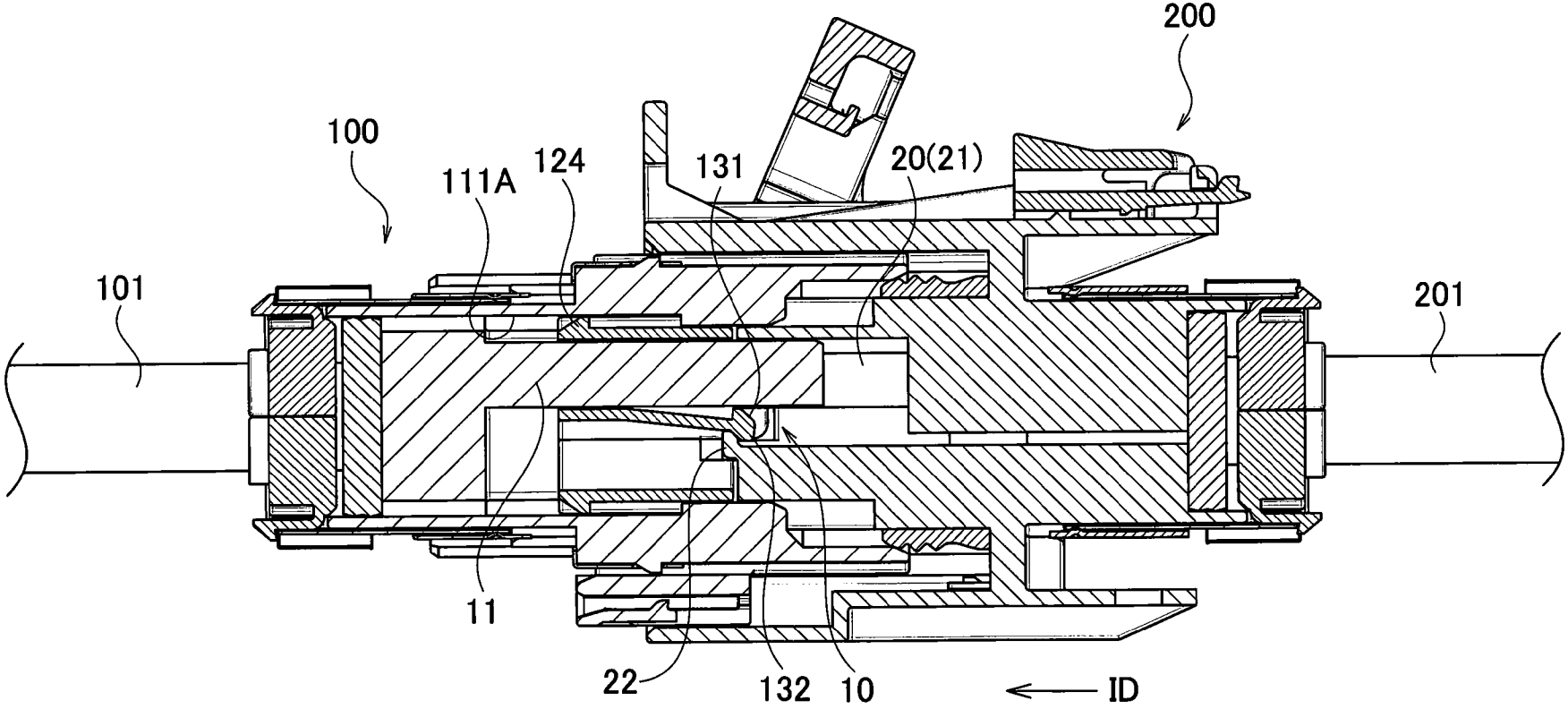
FIG. 13 is a fifth operational view of the fitting state of the male connector 100 and the female connector 200 according to the first embodiment of the present invention.

As shown in FIG. 13, as the disengagement of the male connector 100 and the female connector 200 is gradually progressed along with rotation of the lever 300, the plate pulling-back piece 22 is locked to the pulling-back locking piece 132 (the locking wall face 132A). Then, when the lock releasing piece 21 and the plate pulling-back piece 22 which sandwich the elastic deformation part 130 therebetween move to the opening side of the male housing 110, the moving plate 120 gradually returns from the retreat position to the initial position.

Figure 14:
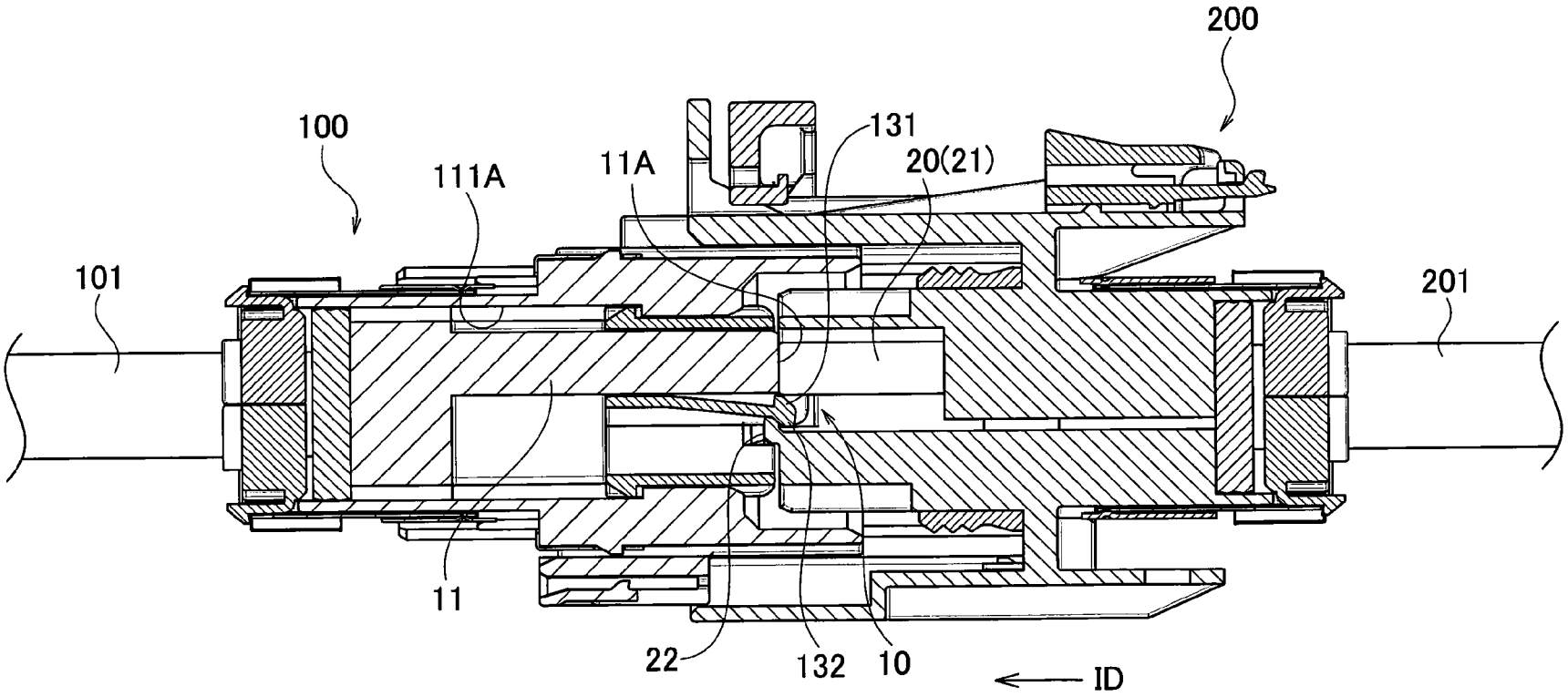
FIG. 14 is a sixth operational view of the fitting state of the male connector 100 and the female connector 200 according to the first embodiment of the present invention.
Figure 15:
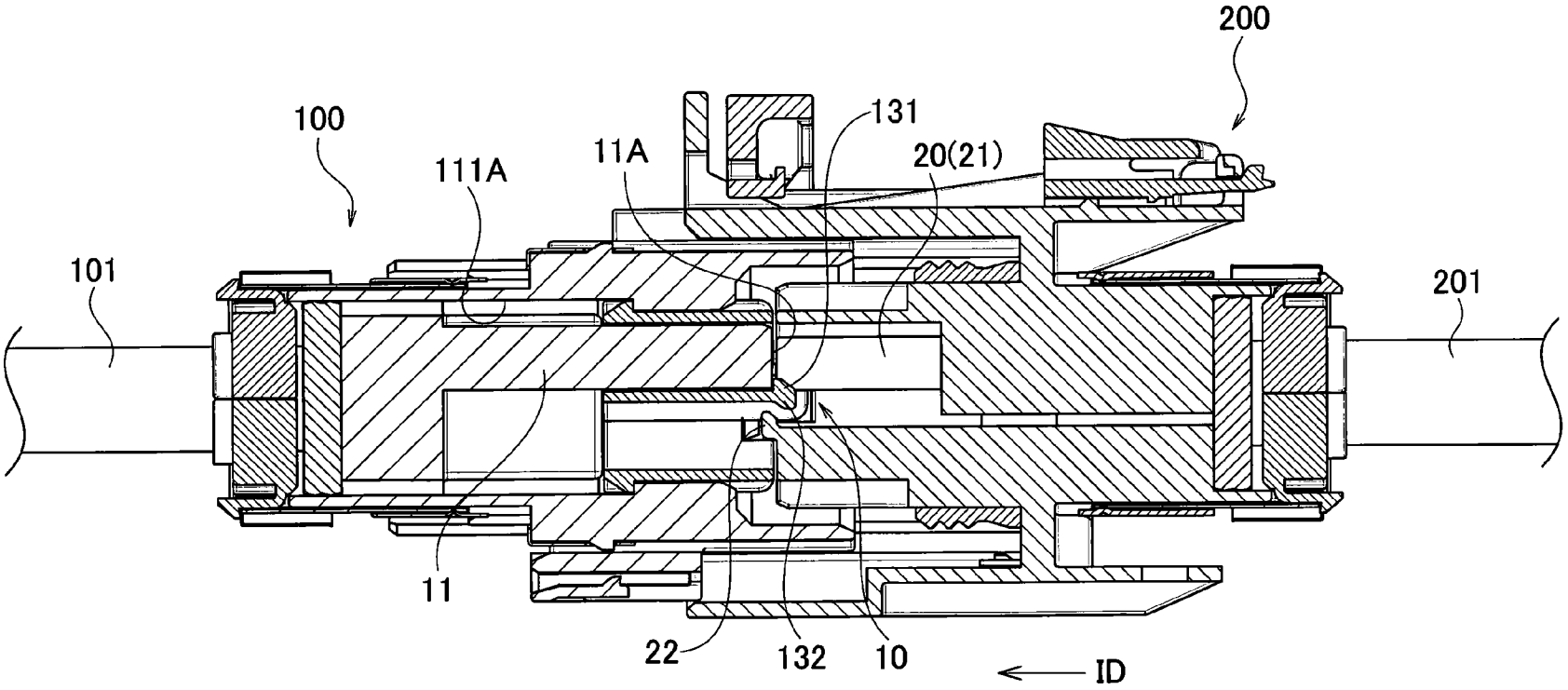
FIG. 15 is a seventh operational view of the fitting state of the male connector 100 and the female connector 200 according to the first embodiment of the present invention.

Next, as shown in FIGS. 14 and 15, when the lock releasing piece 21 disengages from the tip of the elastic deformation part 130 and the locking piece 131 is locked to the tip face 11A of the locking wall 11, the moving plate 120 becomes immovable with respect to the inner housing 111 in the initial position. Then, the locking of the pulling-back locking piece 132 with respect to the plate pulling-back piece 22 is released, and thereby the male connector 100 and the female connector 200 are disengaged from each other. At this time, without the male terminal 102 being exposed to the opening of the male housing 110, the locking protrusion 124 is locked to the front side wall face of the protrusion guide groove 111A. Thereby, the moving plate 120 has prevented from getting out of the inner housing 111.

(6) Operation and Advantages

In the aforementioned first embodiment, the male connector 100 has the initial position locking part 10 which immovably locks the moving plate 120 with respect to the male housing 110 in the initial position. Thereby, the moving plate 120 can block the opening of the male housing 110 upon disengagement of the male connector 100 and the female connector 200. Therefore, a tool or the like or a finger or the operator can be prevented from touching the male terminal 102, and protection of the male terminal 102 against a tool or the like having a potential for contact with the male terminal 102 can be ensured. In addition, even if the operator has pressed the moving plate 120 to the retreat position side, since the moving plate 120 is locked to the initial position locking part 10, protection of the male terminal 102 against a tool or the like having a potential for contact with the male terminal 102 can be reliably ensured.

Moreover, in a state that the locking releasing part 20 has released the locking of the moving plate 120 by the initial position locking part 10, insertion of the female housing 210 inside the male housing 110 moves the moving plate 120 from the initial position to the retreat position. Thereby, since by simply inserting the female housing 210 into the opening of the male housing 110, the moving plate 120 is moved to the retreat position, there is no need to remove the moving plate 120 from the male housing 110, and whereby the male connector 100 and the female connector 200 can be easily fitted to each other.

In the first embodiment, the lock releasing piece 21 is abutted against the locking piece 131 with the female housing 210 being inserted into the opening of the male housing 110, and elastically deforms the elastic deformation part 130 such that the locking of the locking piece 131 with respect to the locking wall 11 is released. Thereby, with a simple construction, protection of the male terminal 102 against a tool or the like having a potential for contact with the male terminal 102 can be reliably ensured. In addition, since by simply inserting the female housing 210 into the opening of the male housing 110, the locking of the locking piece 131 with respect to the locking wall 11 is released, the male connector 100 and the female connector 200 can be still more easily fitted to each other.

In the first embodiment, the moving plate 120 returns from the retreat position to the initial position upon disengagement of the male connector 100 and the female connector 200, and in the initial position, becomes immovable with respect to the male housing 110. Thereby, along with disengagement of the female connector 200 from the male connector 100, the moving plate 120 can block the opening of the male housing 110. Therefore, even if the first connector and the second connector are disengaged from each other, protection of the first terminal against a tool or the like having a potential for contact with the first terminal can be more reliably ensured.

Second Embodiment

Next, a shielded connector 2 according to the second embodiment will be described with reference to the drawings. Note that, the same components as those of the shielded connector 1 according to the aforementioned first embodiment are provided with the same numerals, and mainly the different components will be described.

(1) Construction of Shielded Connector 2

Figure 16:
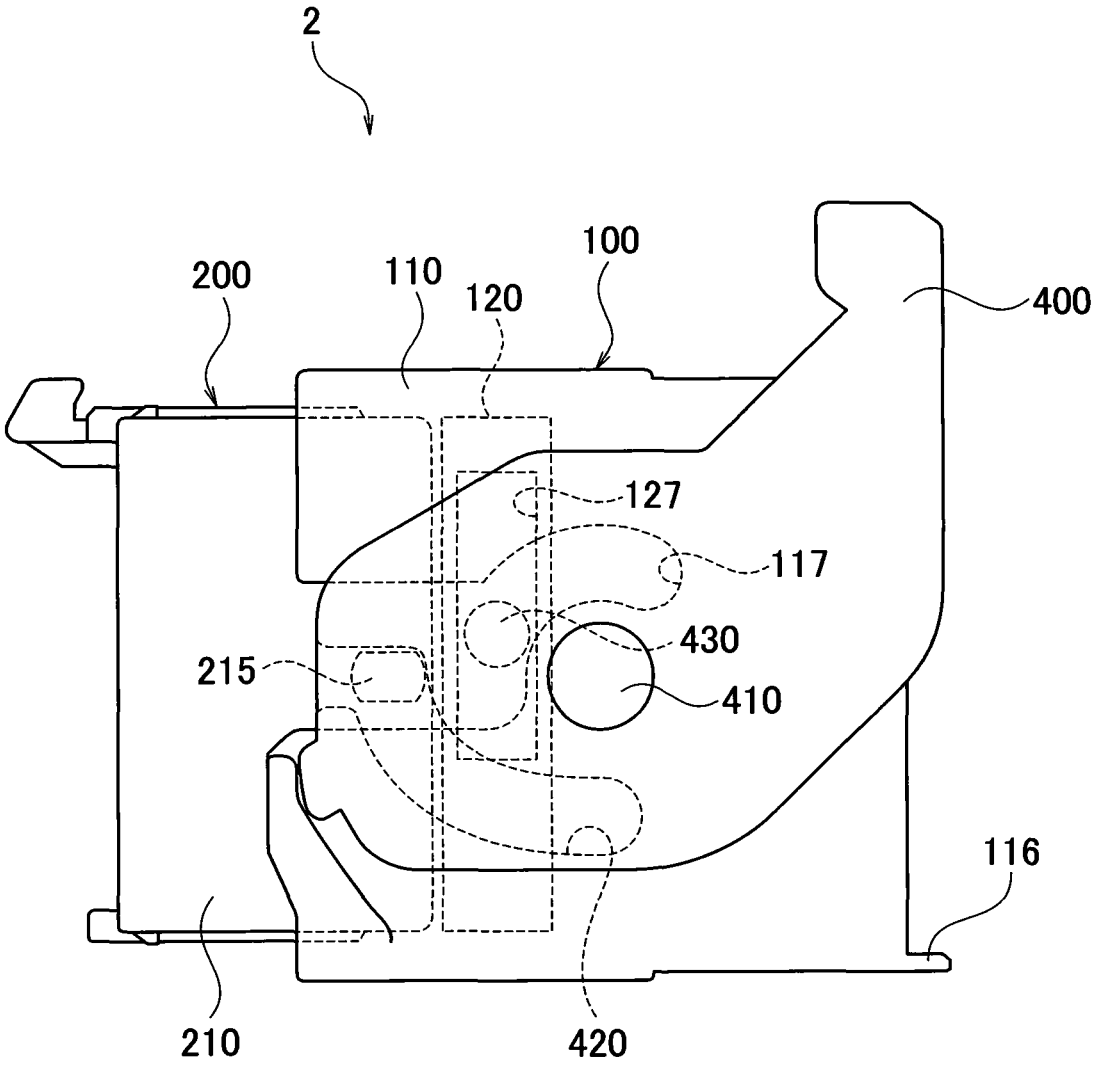
FIG. 16 is a first side view of a shielded connector 2 according to a second embodiment of the present invention.
Figure 17:
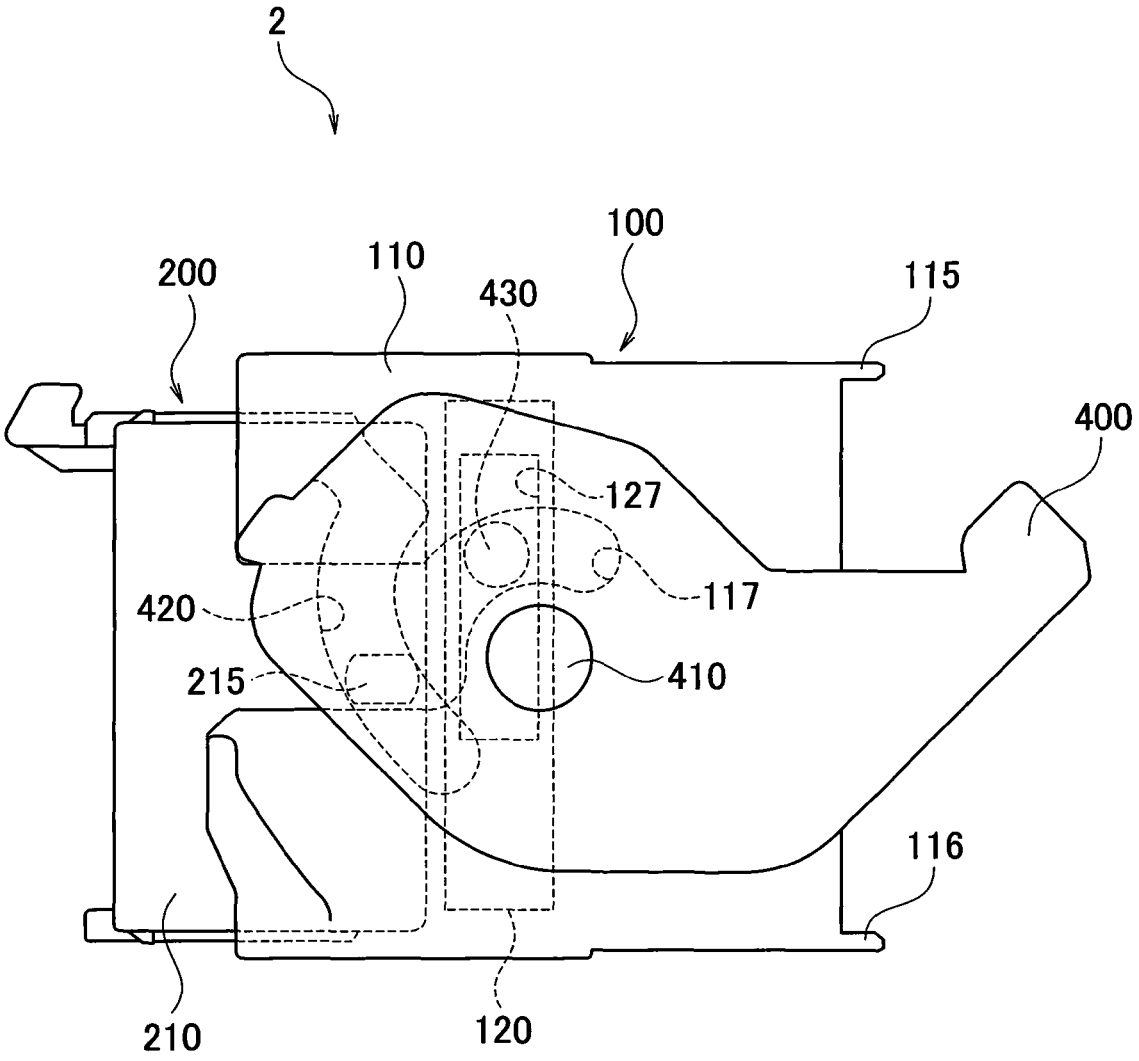
FIG. 17 is a second side view of the shielded connector 2 according to the second embodiment of the present invention.
Figure 18:
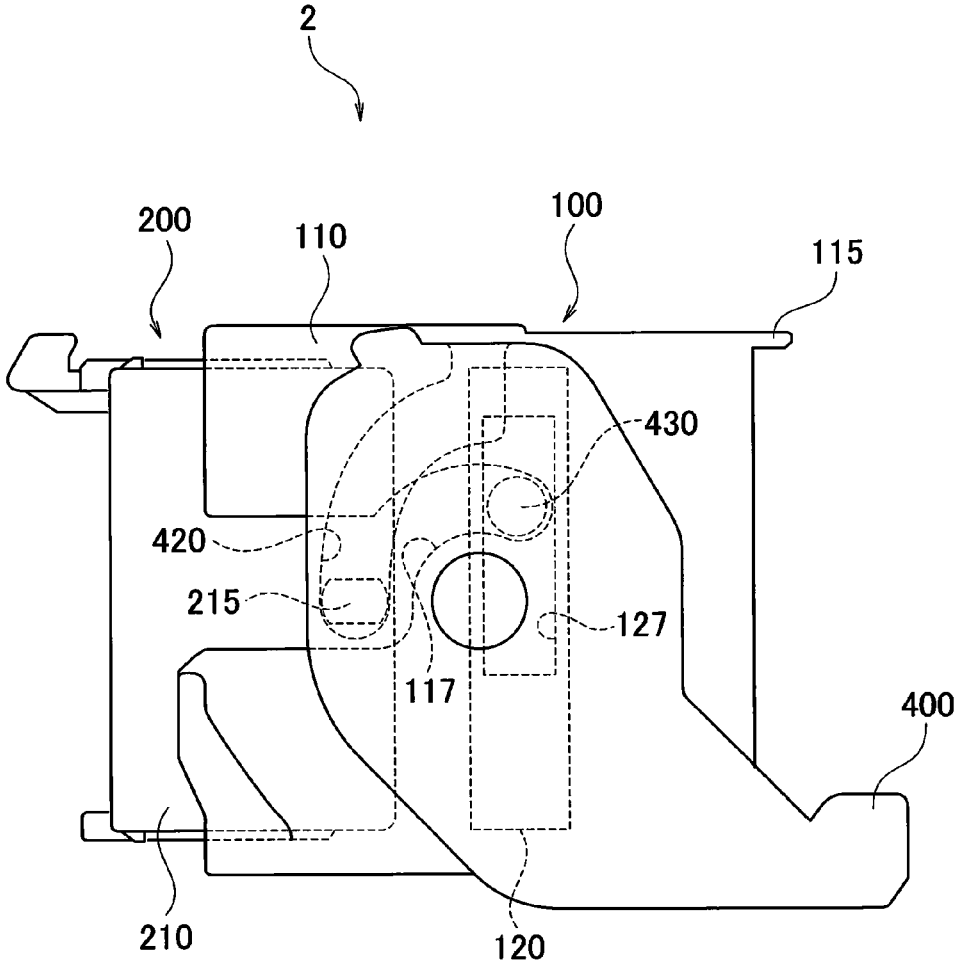
FIG. 18 is a third side view of the shielded connector according to the second embodiment of the present invention.

First, the construction of the shielded connector 2 according to the second embodiment will be described with reference to the drawings. FIGS. 16 to 18 are side views of the shielded connector 2 according to the second embodiment.

Here, in the aforementioned first embodiment, the moving plate 120 is moved from the initial position to the retreat position by pressing of the inner housing 211.

Contrary to this, in the second embodiment, along with rotation of a lever 400 provided in the male housing 110, the moving plate 120 moves between the initial position and the retreat position. Specifically, as shown in FIGS. 16 to 18, the male connector 100 is provided with the lever 400 which fits/disengages the male connector 100 and the female connector 200 to/from each other by rotation.

The lever 400 rotates about a rotation shaft 410. In this lever 400, there is formed a cam groove 420 with which a cam pin 215 formed in the female housing 210 is engaged. In addition, the lever 400 is provided with a pin 430 which protrudes toward the moving plate 120 to move the moving plate 120.

The male housing 110 is provided with a pre-rotation locking part 115 for holding the lever 400 in a position before rotation of the lever 400 (see FIGS. 17 and 18), and a post-rotation locking part 116 for holding the lever 400 in a position after the rotation of the lever 400 (see FIGS. 16 and 17).

Moreover, in the male housing 110, there is formed a guide hole 117 for guiding the pin 430. Then, in the moving plate 120, there is formed a guide hole 127 which is formed along a direction crossing a rotation direction the lever 400, and which allows the pin 430 to move in a predetermined range.

(2) Movement of Moving Plate 120

As shown in FIGS. 16 to 18, in the movement of the pin 430 with respect to the guide hole 117 by rotation of the lever 400, the movement component of the female connector 200 with respect to the male connector 100 in the fitting/disengagement direction moves the moving plate 120 between the initial position and the retreat position.

Specifically, in a case where the male connector 100 and the female connector 200 are fitted to each other, insertion of the female housing 210 inside the male housing 110 brings the pre-rotation locking part 115 and the lever 400 into a released state. The pin 430 is slided inside the guide hole 127 while being guided by the guide hole 117, to be moved in a vertical direction (in an upward direction in the drawing). Then, the moving plate 120 is moved from the initial position to the retreat position inside the male housing 110. In addition, the male terminal 102 is brought into a state in which it is exposed from the moving plate 120, being conduction-connected to the female terminal 202. At this time, the lever 400 is held by the post-rotation locking part 116.

On the other hand, in a case where the male connector 100 and the female connector 200 are disengaged from each other, the disengagement of the female housing 210 from the inside of the male housing 110 brings the post-rotation locking part 116 and the lever 400 into a released state. The pin 430 is slided inside the guide hole 127 while being guided by the guide hole 117, to be moved in a vertical direction (in a downward direction in the drawing). Then, the moving plate 120 returns from the retreat position to the initial position inside the male housing 110. In addition, the lever 400 is held by the pre-rotation locking part 115 with the male terminal 102 being not exposed from the moving plate 120.

Herein, in the second embodiment, the pre-rotation locking part 115 constitutes an initial position locking part for holding the moving plate 120 in the initial position inside the male housing 110. In addition, upon the fitting of the male connector 100 and the female connector 200, the female housing 210 constitutes a locking releasing part which releases the pre-rotation locking part 115 and the lever 400 by being inserted inside the male housing 110 to releases the locking of the moving plate 120 with respect to the male housing 110.

(3) Operation and Advantages

In the aforementioned second embodiment, the movement component of the female connector 200 with respect to the male connector 100 in the fitting/disengagement direction moves the moving plate 120 between the initial position and the retreat position. Thereby, along with rotation of the lever 400, the moving plate 120 can be moved between the initial position and the retreat position. Therefore, with protection of the male terminal 102 against a tool or the like having a potential for contact with the male terminal 102 being ensured, fitting/disengagement of the male connector 100 and the female connector 200 to/from each other can be easily performed.

Other Embodiments

As described above, the contents of the present invention have been disclosed through the embodiments of the present invention, but, the statements and the drawings constituting part of this disclosure do not limit the present invention. From this disclosure, various alternative embodiments, embodiment examples, and operation technologies will become obvious to any person with an ordinary skill in the art.

For example, the embodiments of the present invention can be altered as follows. Specifically, the first and second embodiments have been described on the assumption that the moving plate 120 is provided for the male connector 100, but, the configuration is not limited to this, and the moving plate 120 may be provided for the female connector 200.

Furthermore, the second embodiment has been described on the assumption that the pin 430 is provided for the lever 400, and the guide hole 127 is provided for the moving plate 120, but, the configuration is not limited to this, and the pin 430 may be provided for the moving plate 120, while the guide hole 127 may be provided for the lever 400.

Thus, it is needless to say that the present invention includes various embodiments, and the like, which are not disclosed here. Therefore, the technical scope of the present embodiment is defined only by the subject matters according to the claims that are reasonable from the aforementioned description.

What is claimed is:

1. A shielded connector comprising:

a first connector having a first housing in which a first terminal is housed; and a second connector having a second housing in which a second terminal is housed and being fitted to the first connector, wherein the second housing is inserted inside the first housing, and thereby the first connector and the second connector are fitted to each other to connect the first terminal and the second terminal, the first connector has:

a moving plate which is housed inside the first housing, and is movable between an initial position on the near side of the first terminal and a retreat position on the back side thereof in an insertion direction of the second housing; and an initial position locking part for immovably locking the moving plate with respect to the first housing in the initial position by locking a locking piece provided to the moving plate with respect to the initial position locking part, the second connector has:

a locking releasing part which, when the second housing is inserted into an opening of the first housing, is abutted against the locking piece to elastically deform the locking piece so as to release the locking of the moving plate with respect to the initial position locking part, and a plate pulling-back piece which, when the locking piece is elastically deformed, is abutted against a pulling-back locking piece provided in a location opposed to the locking piece, and the moving plate moves from the initial position to the retreat position by the insertion of the second housing inside the first housing in a state that the locking releasing part has released the locking of the moving plate by the initial position locking part to elastically deform the locking piece, and the moving plate moves from the retreat position to the initial position when the plate pulling-back piece is abutted against the pulling-back locking piece by the disengagement of the second housing from the first housing.

2. The shielded connector according to claim 1, wherein the initial position locking part includes a locking wall which is housed inside the first housing and extends along the insertion direction, and the tip of the locking wall faces the opening of the first housing, the moving plate has an elastic deformation part which has, at the tip of the elastic deformation part exposed to the opening of the first housing, the locking piece which is locked to the tip of the locking wall in the initial position, and the locking releasing part has a lock releasing piece which is abutted against the locking piece when the second housing is inserted into the opening of the first housing, and elastically deforms the elastic deformation part such that the locking of the locking piece with respect to the locking wall is released.

3. The shielded connector according to claim 2, wherein the second connector has the plate pulling-back piece which, in cooperation with the lock releasing piece, sandwiches the elastic deformation part that has been elastically deformed by abutting against the lock releasing piece, and the moving plate, returns, upon disengagement of the first connector and the second connector from each other, from the retreat position to the initial position along with the movement of the lock releasing piece and the plate pulling-back piece which sandwich the elastic deformation part therebetween to the opening side of the first housing; and becomes immovable with respect to the first housing in the initial position when the lock releasing piece is disengaged from the tip of the elastic deformation part and the locking piece is locked to the locking wall.

* * * * *